US010376752B2

(12) United States Patent
Higdon et al.

(10) Patent No.: US 10,376,752 B2
(45) Date of Patent: Aug. 13, 2019

(54) HOSEL INSERT FOR A GOLF CLUB HEAD

(71) Applicant: KARSTEN MANUFACTURING CORPORATION, Phoenix, AZ (US)

(72) Inventors: David A. Higdon, Phoenix, AZ (US); Travis D. Milleman, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/633,505

(22) Filed: Jun. 26, 2017

(65) Prior Publication Data

US 2017/0291078 A1 Oct. 12, 2017

Related U.S. Application Data

(63) Continuation-in-part of application No. 15/086,322, filed on Mar. 31, 2016, now abandoned.

(60) Provisional application No. 62/141,125, filed on Mar. 31, 2015.

(51) Int. Cl.

| | |
|---|---|
| ***A63B 53/02*** | (2015.01) |
| ***A63B 53/04*** | (2015.01) |
| *A63B 53/00* | (2015.01) |
| *A63B 71/06* | (2006.01) |

(52) U.S. Cl.

CPC ..... *A63B 53/02* (2013.01); *A63B 53/047* (2013.01); *A63B 2053/005* (2013.01); *A63B 2053/025* (2013.01); *A63B 2053/0408* (2013.01); *A63B 2053/0412* (2013.01); *A63B 2071/0694* (2013.01); *A63B 2220/13* (2013.01)

(58) Field of Classification Search

CPC ..... A63B 2053/023; A63B 2053/026
USPC ..... 473/244, 245, 248, 305
See application file for complete search history.

(56) References Cited

U.S. PATENT DOCUMENTS

| | | | | | |
|---|---|---|---|---|---|
| 1,133,129 | A | * | 3/1915 | Govan | A63B 53/0466 473/337 |
| 2,067,556 | A | | 1/1937 | Wettlaufer | |
| 2,363,991 | A | * | 11/1944 | Reach | A63B 60/54 473/306 |
| 5,181,720 | A | * | 1/1993 | Stites, III | A63B 60/00 473/312 |
| 5,205,553 | A | * | 4/1993 | Okumoto | A63B 60/00 473/312 |
| 5,324,033 | A | * | 6/1994 | Fenton, Jr. | A63B 60/00 473/305 |
| 5,380,005 | A | * | 1/1995 | Hsu | A63B 60/00 473/311 |
| 5,395,109 | A | * | 3/1995 | Fenton, Jr. | A63B 60/00 473/324 |
| 5,451,048 | A | * | 9/1995 | Magamoto | A63B 60/00 473/347 |
| 5,564,705 | A | * | 10/1996 | Kobayashi | A63B 53/04 473/334 |

(Continued)

FOREIGN PATENT DOCUMENTS

| | | | | |
|---|---|---|---|---|
| WO | WO 9832500 A1 | * | 7/1998 | A63B 53/04 |

*Primary Examiner* — William M Pierce

(57) ABSTRACT

Various embodiments of a golf club head comprising a body having a strike face, a heel portion, and a toe portion, a hosel having a body with a first end, extending from the heel portion of the body of the club head, and a second end, configured to receive a shaft, a cavity positioned adjacent to the body of the hosel, and an insert configured to be secured within the cavity are described herein.

18 Claims, 9 Drawing Sheets

(56) References Cited

U.S. PATENT DOCUMENTS 5,647,807 A 7/1997 Nagamoto
5,695,409 A * 12/1997 Jackson ..... A63B 53/02 473/305
6,186,903 B1 * 2/2001 Beebe ..... A63B 53/02 473/248
6,431,995 B1 * 8/2002 Jackson ..... A63B 53/04 473/305
6,752,726 B2 6/2004 Burrows
6,923,734 B2 * 8/2005 Meyer ..... A63B 53/04 473/336
D597,158 S * 7/2009 Schweigert ..... D21/747
7,594,863 B2 * 9/2009 Ban ..... A63B 53/047 473/331
7,927,230 B2 4/2011 Solheim
8,105,178 B2 1/2012 Sander
8,382,608 B2 * 2/2013 Solheim ..... A63B 53/047 473/329
8,715,104 B1 5/2014 Wall et al.
8,939,848 B2 * 1/2015 Soracco ..... A63B 53/0475 473/329
9,028,340 B2 * 5/2015 Ban ..... A63B 53/047 473/331
9,044,653 B2 * 6/2015 Wahl ..... A63B 53/0475
9,132,323 B2 * 9/2015 Beach ..... A63B 53/02
9,630,067 B2 4/2017 Kohno et al.
9,731,176 B2 * 8/2017 Issertell ..... A63B 53/047
9,901,789 B2 * 2/2018 Kitagawa ..... A63B 53/0466
9,901,792 B2 * 2/2018 Franklin ..... A63B 53/04
9,937,389 B2 * 4/2018 Kitagawa ..... A63B 53/0466
9,943,732 B2 * 4/2018 Jacaman ..... A63B 53/02
9,950,219 B2 * 4/2018 Larson ..... A63B 53/0466
9,987,529 B2 * 6/2018 Jertson ..... A63B 53/04
10,046,211 B2 * 8/2018 Franklin ..... A63B 53/0487
2001/0001774 A1 * 5/2001 Antonious ..... A63B 53/04 473/349
2003/0199331 A1 10/2003 Stites
2005/0043111 A1 * 2/2005 Albert ..... A63B 53/04 473/324
2008/0102977 A1 5/2008 Huang et al.
2008/0300065 A1 12/2008 Schweigert
2009/0029791 A1 * 1/2009 Solheim ..... A63B 53/047 473/291
2009/0325728 A1 * 12/2009 Solheim ..... A63B 53/047 473/331
2010/0035702 A1 * 2/2010 Solheim ..... A63B 53/04 473/330
2010/0113179 A1 * 5/2010 Solheim ..... A63B 53/047 473/331
2010/0279785 A1 11/2010 Oldknow et al.
2010/0279787 A1 * 11/2010 Stites ..... A63B 53/02 473/324
2011/0207551 A1 * 8/2011 Breier ..... A63B 53/047 473/332
2012/0289360 A1 * 11/2012 Breier ..... A63B 53/047 473/335
2013/0217513 A1 * 8/2013 Amano ..... A63B 53/04 473/331
2013/0225319 A1 * 8/2013 Kato ..... A63B 53/047 473/331
2014/0087892 A1 3/2014 Taylor et al.
2016/0059089 A1 * 3/2016 Jertson ..... A63B 53/047 473/290
2017/0120112 A1 * 5/2017 Stokke ..... A63B 53/04
2017/0274253 A1 * 9/2017 Stokke ..... A63B 53/047
2017/0291078 A1 * 10/2017 Higdon ..... A63B 53/02
2018/0178094 A1 * 6/2018 Morales ..... A63B 53/047
2018/0256946 A1 * 9/2018 Stokke ..... A63B 53/04

* cited by examiner

| CLUB HEAD 4 | LIE ANGLE 72 |
|---|---|
| 4 - IRON | 59.0 |
| 5 - IRON | 60.0 |
| 6 - IRON | 60.9 |
| 7 - IRON | 61.9 |
| 8 - IRON | 62.8 |
| 9 - IRON | 63.8 |

*FIG. 6*

| INDICATOR 108 | CUSTOM LIE ANGLE 104 |
|---|---|
| MAROON | 4.5° (UPRIGHT) |
| SILVER | 3.75° (UPRIGHT) |
| WHITE | 3° (UPRIGHT) |
| GREEN | 2.25° (UPRIGHT) |
| YELLOW | 1.5° (UPRIGHT) |
| BLUE | 0.75° (UPRIGHT) |
| BLACK | 0° |
| RED | 0.75° (FLAT) |
| PURPLE | 1.5° (FLAT) |
| ORANGE | 2.25° (FLAT) |
| BROWN | 3° (FLAT) |
| GOLD | 3.75° (FLAT) |

*FIG. 7*

HOSEL INSERT FOR A GOLF CLUB HEAD

CROSS-REFERENCE TO RELATED APPLICATIONS

This is a continuation in part of U.S. patent application Ser. No. 15/086,322, filed on Mar. 31, 2016, which claims priority to U.S. Provisional Patent Application No. 62/141,125, filed on Mar. 31, 2015, all of which are incorporated by reference herein in their entirety.

FIELD OF INVENTION

The present disclosure relates to golf clubs. In particular, the present disclosure relates to iron-type golf club heads, wedge-type golf club heads, and hybrid-type golf club heads.

BACKGROUND

Many golf club heads include cavities positioned in the hosel to direct stress to the location of the cavity during bending to achieve a desired lie angle. When the stress is directed to the cavity during bending, the stress is relieved from the rest of the club head, thereby maintaining the performance characteristics of the club head body. The desired lie angle may be different for different golfers. Identifying the lie angles of particular golf club heads is beneficial to golfers and golf club manufacturers.

BRIEF DESCRIPTION OF THE DRAWINGS

FIG. 6 illustrates a set of golf clubs having varying lie angles.

FIG. 7 illustrates the variations of the indicator of the insert in FIG. 5.

Figure 1:
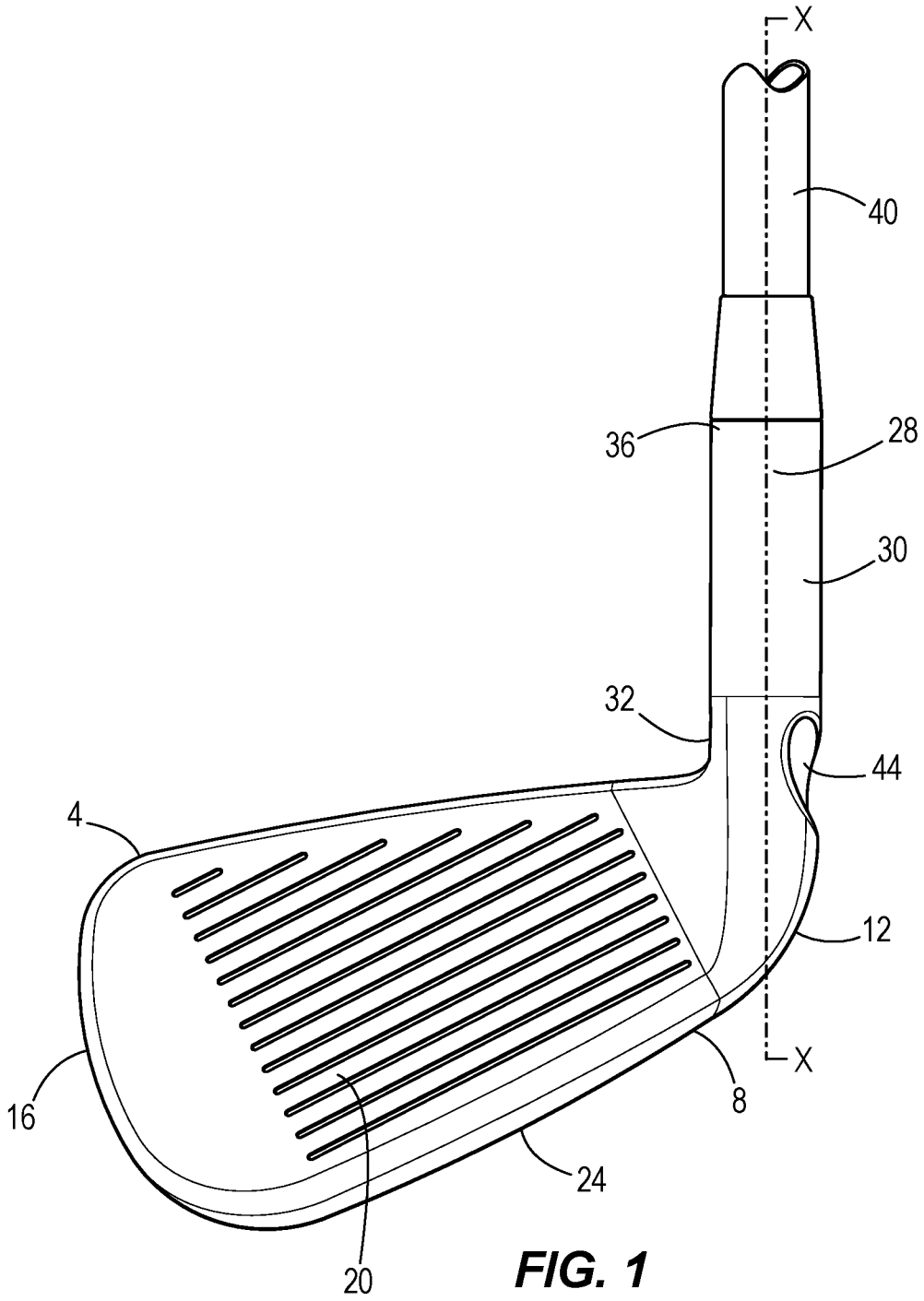
FIG. 1 illustrates a golf club head with a cavity.
Figure 2:
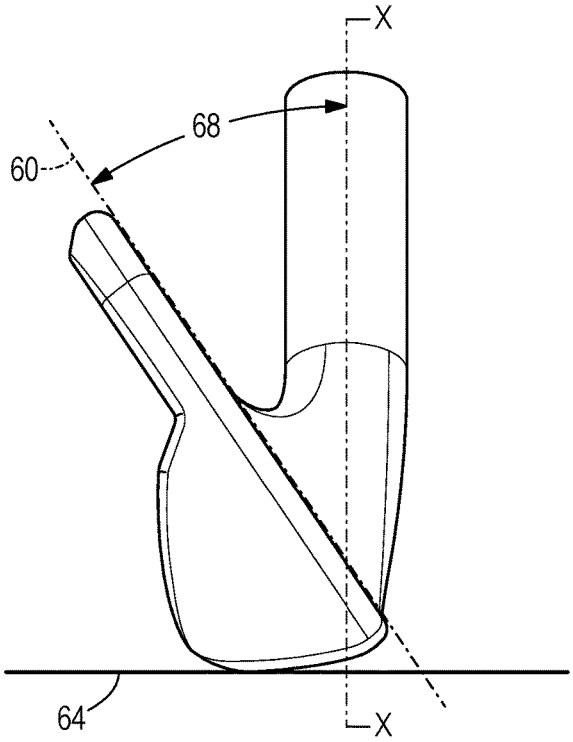
FIG. 2 illustrates a side view of the golf club head in FIG. 1.
Figure 3:
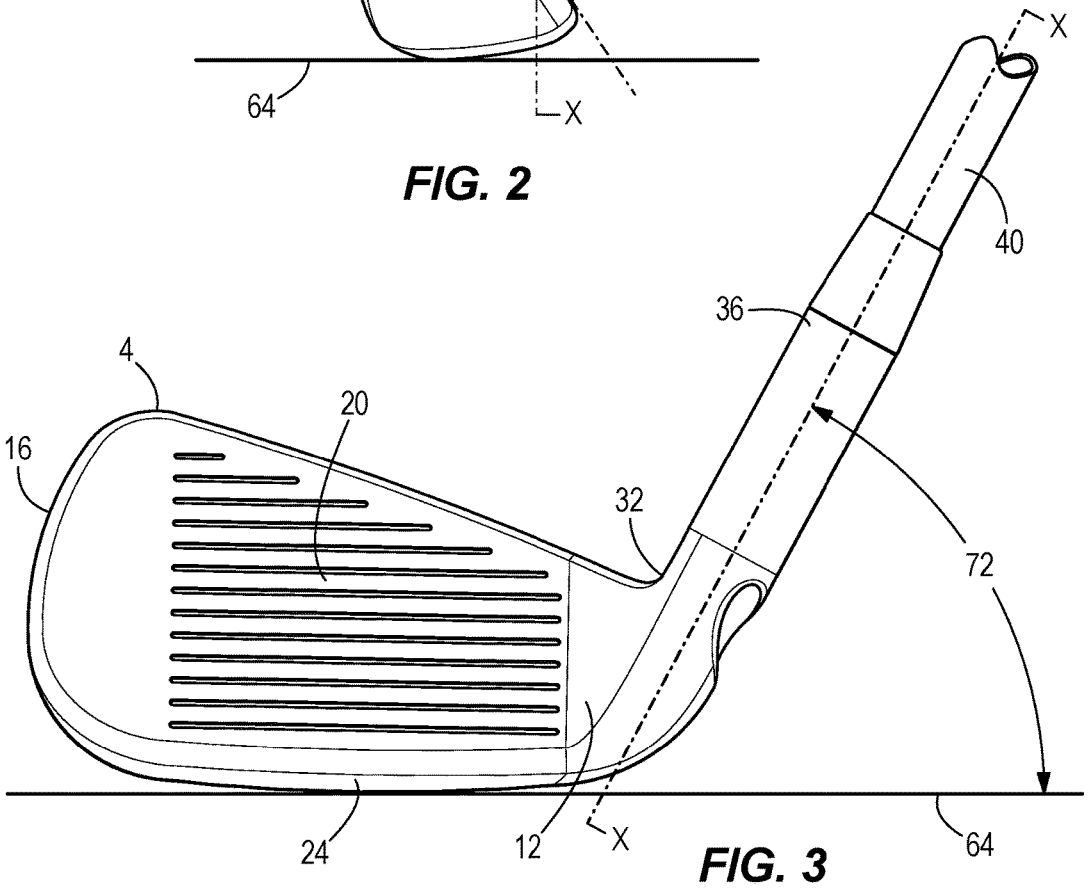
FIG. 3 illustrates another view of the golf club head in FIG. 1.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The inventors have discovered an insert, able to be positioned within the cavity of a golf club hosel, to create a more uniform appearance of golf club heads. The insert may also indicate the lie angle of each golf club determined during custom fitting of a golfer.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-5 illustrate a golf club head 4 including a body 8 with a heel portion 12, a toe portion 16, a strike face 20, and a sole 24. The club head 4 further includes a hosel 28 having a body 30 with a first end 32 extending from the heel portion 12 of the body 8, a second end 36 configured to receive a shaft 40, and a cavity 44 configured to receive an insert 48. The cavity includes two or more protrusions 92 on a perimeter thereof. The hosel defines a longitudinal axis X extending through the center of the hosel 28 from the first end 32 to the second end 36. The strike face 20 of the body 8 defines a loft plane 60 of the club head 4. The sole 24 of the body 8 defines a sole plane 64 of the club head 4, tangent to the center point of the sole 24. The club head 4 further includes a loft angle 68, defined as the angle between the loft plane 60 and the longitudinal axis X, and a lie angle 72, defined as the angle between the sole plane 64 and the longitudinal axis X.

Figure 4:
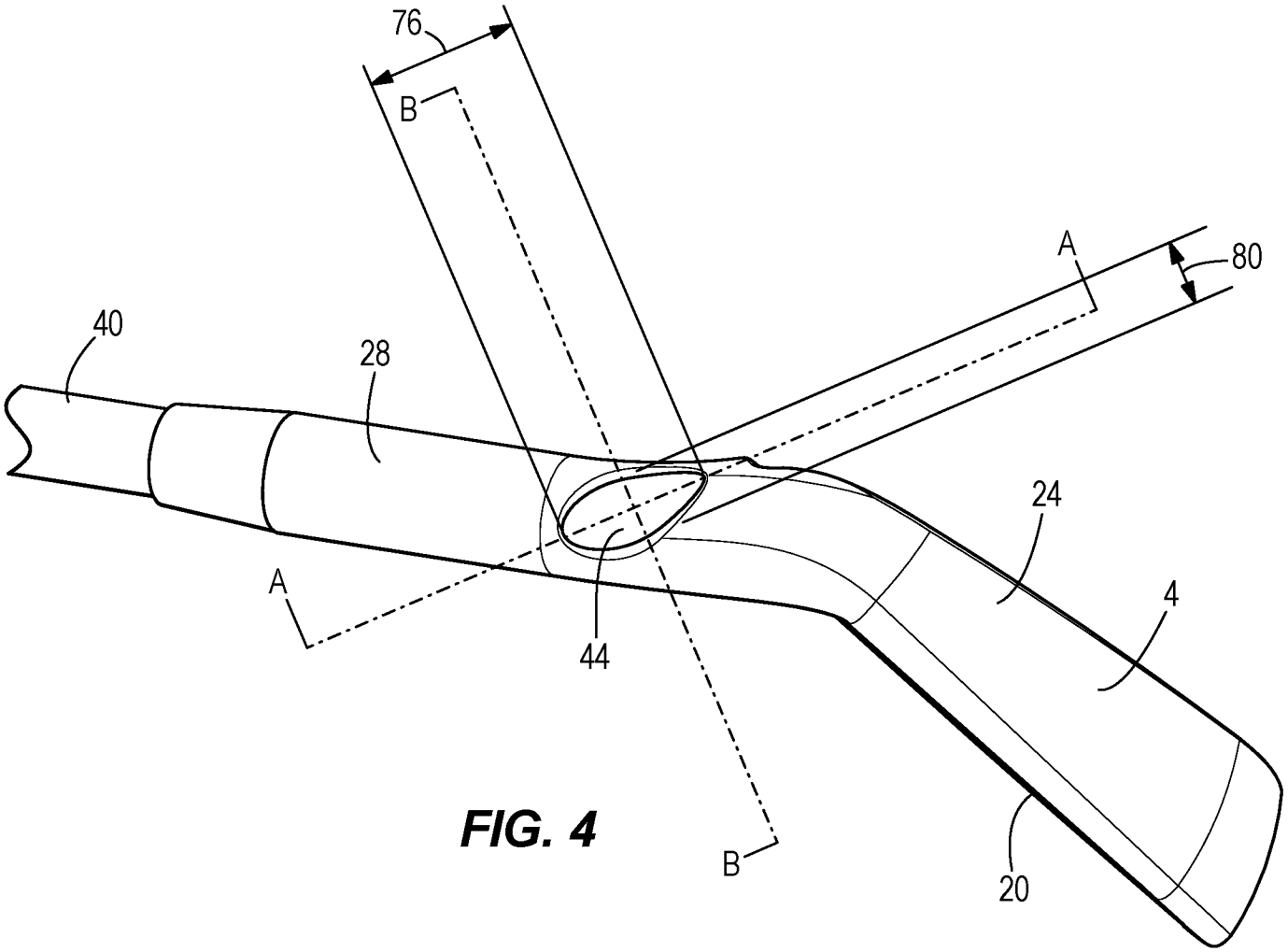
FIG. 4 illustrates a perspective view of the golf club head in FIG. 1.

Referring to FIG. 4, the cavity 44 is positioned adjacent to the first end 32 of the hosel 28 and is directed toward the sole 24 of the club head 4. The cavity 44 is further positioned on the hosel 28 such that the cavity 44 is visible from a front view and a sole view of the club head 4. In the illustrated embodiment, the cavity is substantially elliptical in shape and has a length 76, a width 80, and a volume (not shown). In many embodiments, the length 76 extends through the center of the cavity along an axis A perpendicular to the strike face 20 and substantially bisecting the cavity 44. In many embodiments, the width 80 extends through the center of the cavity along an axis B parallel to the strike face 20 and substantially bisecting the cavity 44. The volume of the cavity 44 is defined as the volume of material removed from the body 30 of the hosel 28 of the club head 4 to create the cavity 44. In other embodiments, the cavity may be circular, square, rectangular, triangular, trapezoidal, or any other shape capable of directing stress to the cavity and away from the rest of the club head 4.

The cavity 44, illustrated in FIG. 4, is positioned in the hosel 28 to allow bending of the club head 4 to the appropriate lie angle. The cavity 44 directs stress to the location of the cavity during bending and relieves stress from the rest of the club head 4, thereby maintaining the performance characteristics of the body 8 of the club head 4. The greater the volume of the cavity, the more stress is directed away from the rest of the club head 4, thereby better preserving the performance characteristics of the body 8 of the club head 4. However, increasing the volume of the cavity may detract from the uniform appearance of the golf club head 4.

Figure 5:
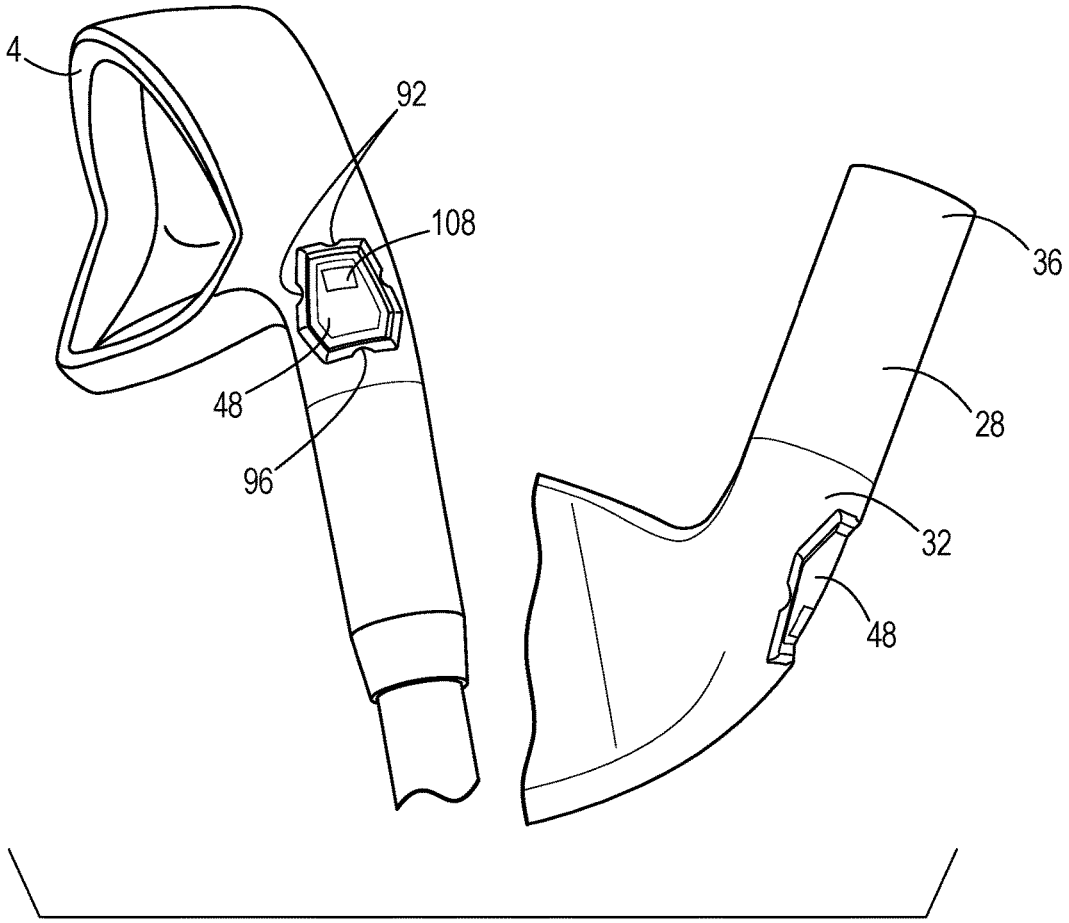
FIG. 5 illustrates the golf club head of FIG. 1 having an insert with an indicator positioned within the cavity.

The insert 48, illustrated in FIG. 5, is configured to be positioned or secured within the cavity 44 to maintain a uniform appearance of the golf club head 4 and the first end 32 of the hosel 28. The insert 48 is sized and shaped to be matingly received within the cavity 44. For example, the insert 48 may be circular, square, rectangular, elliptical, ovular, triangular, trapezoidal, or any other shape or combination of shapes. The insert 48 may be positioned within the cavity such that the insert 48 is flush with an outer surface of the hosel 28 to achieve a uniform appearance. The insert 48 may also be positioned within the cavity such that the insert 48 is recessed or protruding relative to the outer surface of the hosel 28.

The insert 48 may comprise a flexible material and include two or more grooves 96 in the insert 48 that are configured to align with the protrusions 92 on the perimeter walls of the cavity 44. The insert 48 may be secured within the cavity 44 using a press fit mechanism. The grooves 96 of the insert 48 may be aligned with the protrusions 92 of the cavity 44, and the insert 48 pressed into the cavity 44 to achieve a press fit. The flexibility of the insert 48 allows the insert 48 to compress upon positioning within the cavity 44. When the insert 48 is released, after being positioned in the cavity 44, the insert 48 expands resulting in a press fit. The press fit allows the insert 48 to remain positioned within the cavity 44 after insertion.

In other embodiments, the insert 48 may be made of any flexible or rigid material (e.g. polyurethane, polyethylene, other plastics, stainless steel, titanium, tungsten, other metal, composites, metal alloys, or any other material). Further, the insert 48 may be secured within the cavity using mechanisms other than a press fit mechanism, such as an adhesive backing, a screw, or a mechanical fastener.

Referring to FIG. 6, golf clubs are typically sold in sets, each set including golf clubs with heads 4 having varying loft angles 68. For example, a set of golf clubs 100 may include a first golf club (e.g. a 4-iron) having a first club head, a second golf club (e.g. a 5-iron) having a second club head, a third golf club (e.g. a 6-iron) having a third club head, a fourth golf club (e.g. a 7-iron) having a fourth club head, a fifth golf club (e.g. an 8-iron) having a fifth club head, and a sixth golf club (e.g. a 9-iron) having a sixth club head, wherein the loft angle 68 of the sixth club head (e.g. the 9-iron) is greater than the loft angle 68 of the fifth club head (e.g. the 8-iron), the loft angle 68 of the fifth club head (e.g. the 8-iron) is greater than the loft angle 68 of the fourth club head (e.g. the 7-iron), the loft angle 68 of the fourth club head (e.g. the 7-iron) is greater than the loft angle 68 of the third club head (e.g. the 6-iron), the loft angle 68 of the third club head (e.g. the 6-iron) is greater than the loft angle 68 of the second club head (e.g. the 5-iron), and the loft angle 68 of the second club head (e.g. the 5-iron) is greater than the loft angle 68 of the first club head (e.g. the 4-iron). This example includes a set of iron-type golf clubs with six golf clubs. However, the set of golf clubs 100 may include more than six or fewer than six golf clubs (e.g. the set of golf clubs 100 may further include a 2-iron and a 3-iron). Further, this example relates specifically to iron-type golf club heads 4, but may apply to wedge-type and hybrid-type golf club heads 4 in addition to iron-type golf club heads 4, or may apply to any combination of iron-type golf club heads, wedge-type golf club heads, and hybrid-type golf club heads.

Further referring to FIG. 6, the cavity of each golf club head 4 within the set of golf clubs 100 increases in size as the loft angles 68 of the club heads 4 increase. For example, the length 76 of the cavities of the club heads 4 increases as the loft angles 68 of the club heads 4 within the set of golf clubs 100 increase. Specifically, the length 76 of the cavity of the sixth club head (e.g. the 9-iron) is greater than the length 76 of the cavity of the fifth club head (e.g. the 8-iron), the length 76 of the cavity of the fifth club head (e.g. the 8-iron) is greater than the length 76 of the cavity of the fourth club head (e.g. the 7-iron), the length 76 of the cavity of the fourth club head (e.g. the 7-iron) is greater than the length 76 of the cavity of the third club head (e.g. the 6-iron), the length 76 of the cavity of the third club head (e.g. the 6-iron) is greater than the length 76 of the cavity of the second club head (e.g. the 5-iron), and the length 76 of the cavity of the second club head (e.g. the 5-iron) is greater than the length 76 of the cavity of the first club head (e.g. the 4-iron).

Further referring to FIG. 6, the width 80 of the cavities of the club heads 4 increases as the loft angles 68 of the club heads 4 within the set of golf clubs 100 increase. Specifically, the width 80 of the cavity of the sixth club head (e.g. the 9-iron) is greater than the width 80 of the cavity of the fifth club head (e.g. the 8-iron), the width 80 of the cavity of the fifth club head (e.g. the 8-iron) is greater than the width 80 of the cavity of the fourth club head (e.g. the 7-iron), the width 80 of the cavity of the fourth club head (e.g. the 7-iron) is greater than the width 80 of the cavity of the third club head (e.g. the 6-iron), the width 80 of the cavity of the third club head (e.g. the 6-iron) is greater than the width 80 of the cavity of the second club head (e.g. the 5-iron), and the width 80 of the cavity of the second club head (e.g. the 5-iron) is greater than the width 80 of the cavity of the first club head (e.g. the 4-iron).

Further referring to FIG. 6, the volume of the cavities of the club heads 4 increases as the loft angles 68 of the club heads 4 within the set of golf clubs 100 increase. Specifically, the volume of the cavity of the sixth club head (e.g. the 9-iron) is greater than the volume of the cavity of the fifth club head (e.g. the 8-iron), the volume of the cavity of the fifth club head (e.g. the 8-iron) is greater than the volume of the cavity of the fourth club head (e.g. the 7-iron), the volume of the cavity of the fourth club head (e.g. the 7-iron) is greater than the volume of the cavity of the third club head (e.g. the 6-iron), the volume of the cavity of the third club head (e.g. the 6-iron) is greater than the volume of the cavity of the second club head (e.g. the 5-iron), and the volume of the cavity of the second club head (e.g. the 5-iron) is greater than the volume of the cavity of the first club head (e.g. the 4-iron). The volume of the cavities may range from 0.1 $cm^3$-0.8 $cm^3$.

Specifically, with reference to FIG. 6, the length 76 of the cavity 44 may range from approximately 0.45 inches to approximately 0.75 inches, or from approximately 0.55 inches to approximately 0.65 inches. For example, the length 76 of the cavity 44 can be approximately 0.45 inches, approximately 0.50 inches, approximately 0.55 inches, approximately 0.60 inches, approximately 0.65 inches, approximately 0.70 inches, or approximately 0.75 inches. Further, the width 80 of the cavity 44 may range from approximately 0.25 inches to approximately 0.40 inches, or from approximately 0.30 inches to approximately 0.35 inches. For example, the width 80 of the cavity 44 can be approximately 0.25 inches, approximately 0.30 inches, approximately 0.35 inches, or approximately 0.40 inches.

In many embodiments, the length 76, the width 80, and the volume of the cavity of each club head 4 within the set of golf clubs 100 increases as the loft angle 68 of the respective club head 4 increases. In some embodiments, the length 76 of the cavity of each club head 4 within the set of golf clubs 100 may remain constant or decrease as the loft angle 68 of the respective club head 4 increases, the width 80 of the cavity of each club head 4 within the set of golf clubs 100 may remain constant or decrease as the loft angle 68 of the respective club head 4 increases, and the width 80 of the cavity of each club head 4 within the set of golf clubs 100 may remain constant or decrease as the loft angle 68 of the respective club head 4 increases.

In many embodiments, the length 76, the width 80, and the volume of the cavity of each golf club head 4 within the set of golf clubs 100 increases as the loft angle 68 increases. Further, the insert 48 increases in size to accommodate the increase in size of the cavity. For example, the insert 48 for the cavity of the sixth club head (e.g. the 9-iron) is larger than the insert 48 for the cavity of the fifth club head (e.g. the 8-iron), the insert 48 for the cavity of the fifth club head (e.g. the 8-iron) is larger than the insert 48 for the cavity of the fourth club head (e.g. the 7-iron), the insert 48 for the cavity of the fourth club head (e.g. the 7-iron) is larger than the insert 48 for the cavity of the third club head (e.g. the 6-iron), the insert 48 for the cavity of the third club head (e.g. the 6-iron) is larger than the insert 48 for the cavity of the second club head (e.g. the 5-iron), and the insert 48 for the cavity of the second club head (e.g. the 5-iron) is larger than the insert 48 for the cavity of the first club head (e.g. the 4-iron).

In some embodiments, a single insert 48 can be positioned or secured within more than one cavity, wherein each cavity comprises a different size (e.g. length 76, width 80, and/or volume). In some embodiments, the insert 48 can be configured to be positioned over or secured within the cavity of any club head within the set of club heads 100 (e.g. the cavity of the first club head, the cavity of the second club head, the cavity of the third club head, the cavity of the fourth club head, the cavity of the fifth club head, the cavity of the sixth club head, or the cavity of any other club head within the set of club heads 100).

Figure 9:
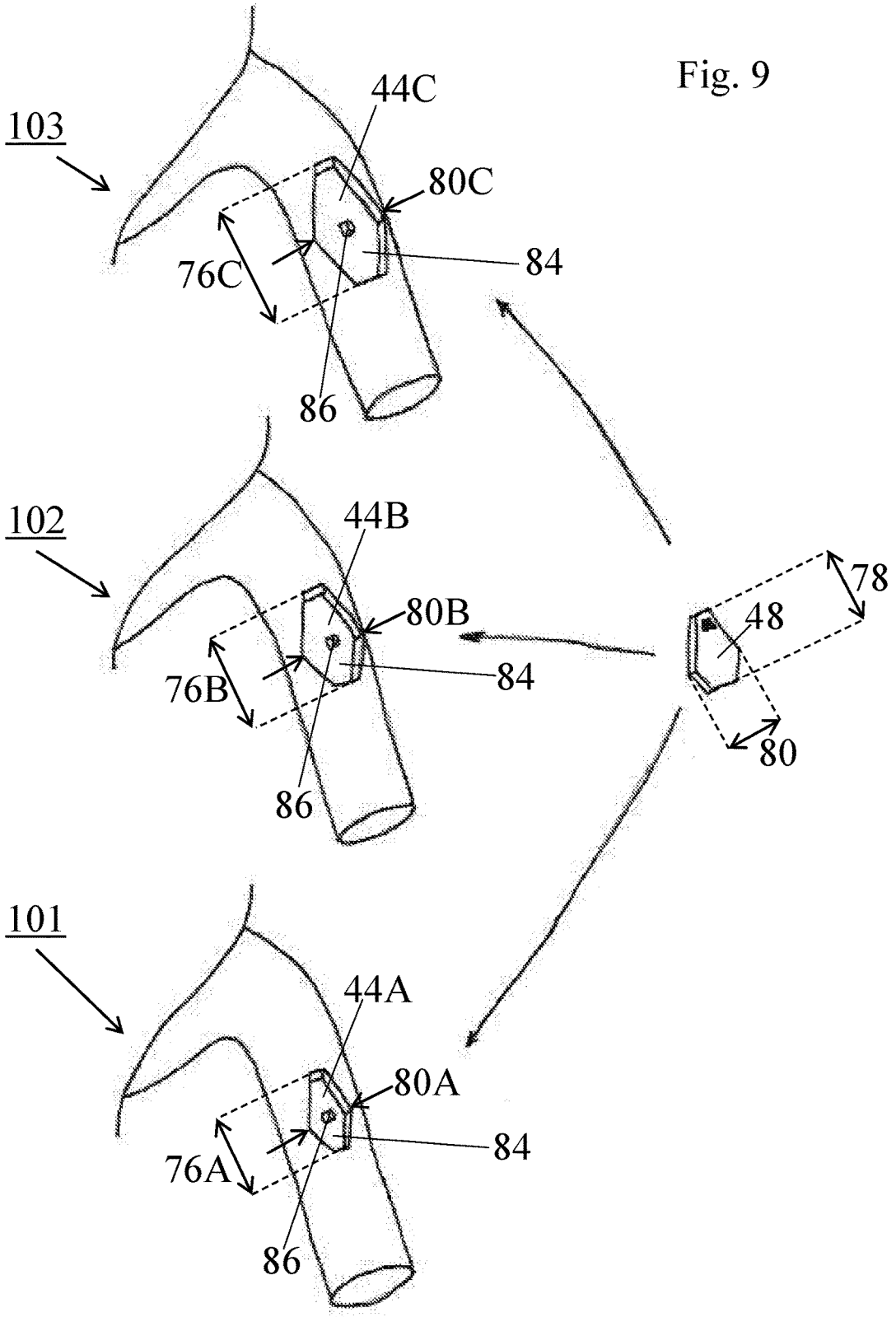
FIG. 9 illustrates a set of golf clubs with cavities capable of receiving a single insert.
Figure 10:
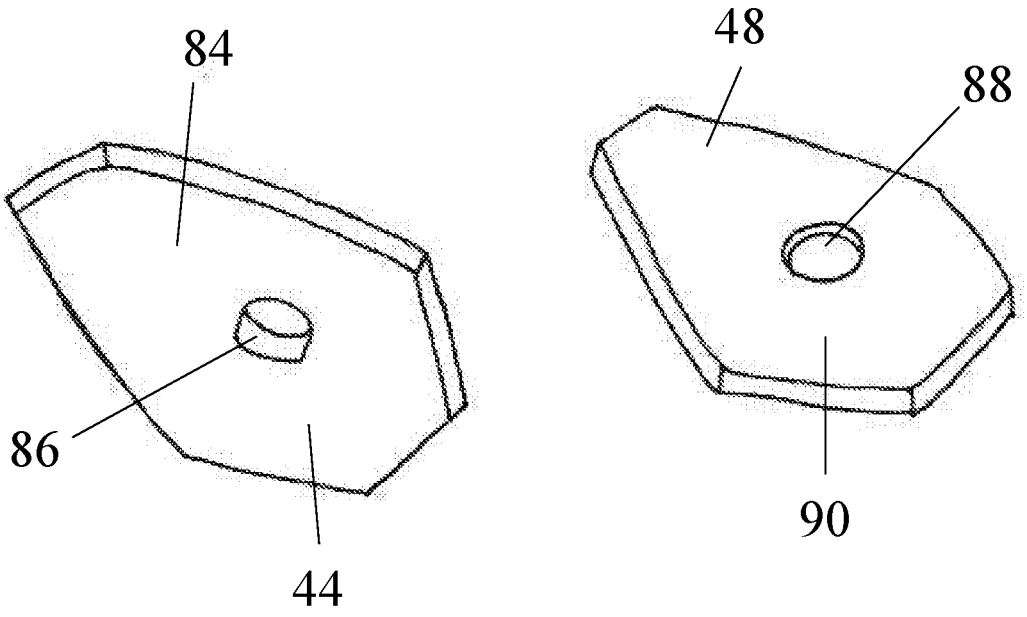
FIG. 10 illustrates an exemplary cavity of a golf club head and an insert positionable over or secured within the cavity.
Figure 11:
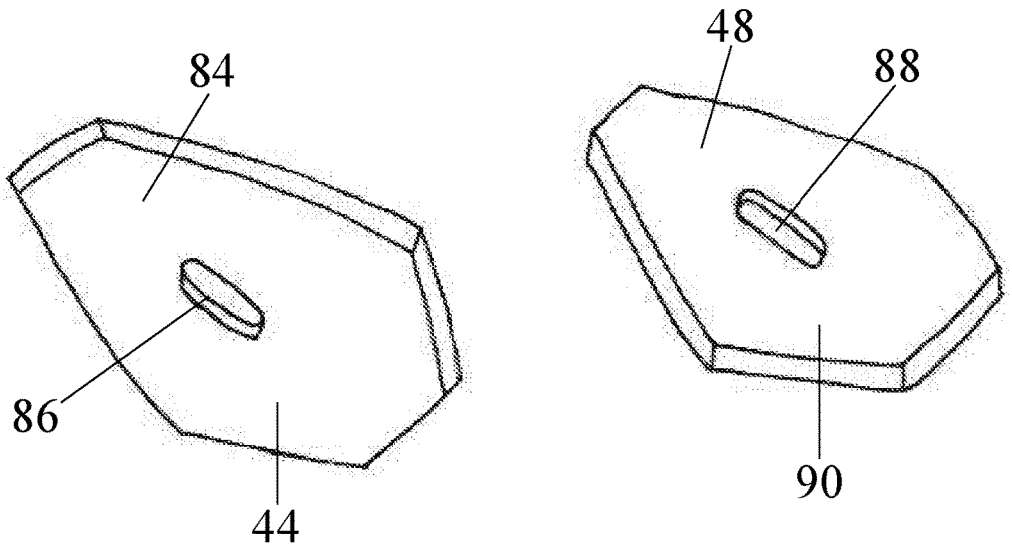
FIG. 11 illustrates another exemplary cavity of a golf club head and an insert positionable over or secured within the cavity.
Figure 12:
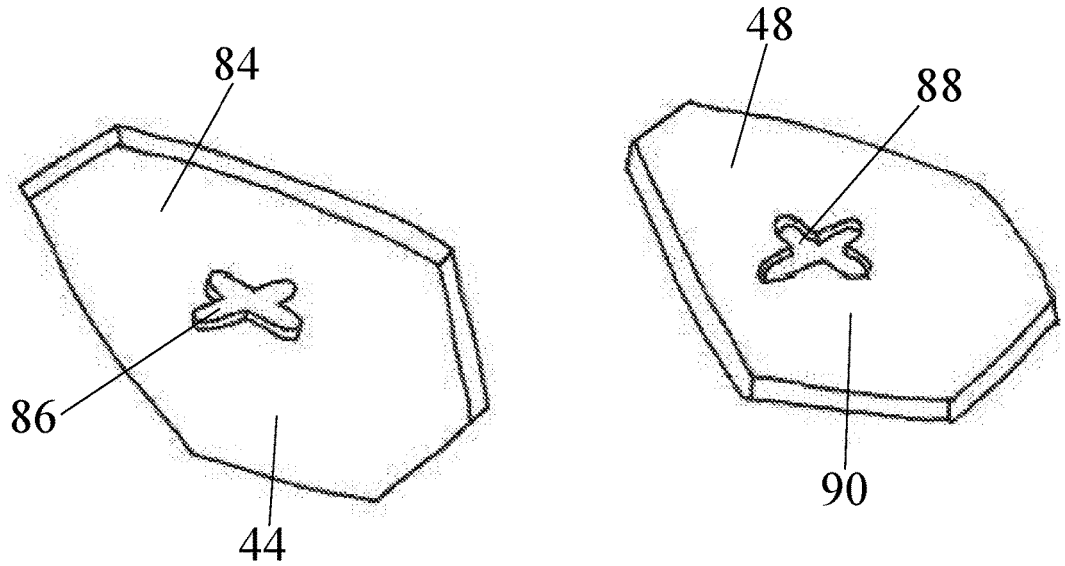
FIG. 12 illustrates another exemplary cavity of a golf club head and an insert positionable over or secured within the cavity.

Referring to FIG. 9, in one embodiment, the set of club heads 100 can include a first club head 101 comprising a first cavity 44A, a second club head 102 having a second cavity 44B, and a third club head 103 having a third cavity 44C. The first cavity 44A of the first club head 101 can have a first length 76A, a first width 80A, and a first volume. The second cavity 44B of the second club head 102 can have a second length 76B, a second width 80B, and a second volume. The third cavity 44C of the third club head 103 can have a third length 76C, a third width 80A, and a third volume.

In the illustrated embodiment of FIG. 9, the length 76C of the third cavity 44C is greater than the length 76B of the second cavity 44B, and the length 76B of the second cavity 44B is greater than the length 76A of the first cavity 44A. Further, in the illustrated embodiment, the width 80C of the third cavity 44C is greater than the width 80B of the second cavity 44B, and the width 80B of the second cavity 44B is greater than the width 80A of the first cavity 44A. Further still, in the illustrated embodiment, the volume of the third cavity 44C is greater than the volume of the second cavity 44B, and the volume of the second cavity 44B is greater than the volume of the first cavity 44A.

Further referring to FIG. 9, each club head within the set of club heads 100, having cavities of varying size, can receive a single insert 48. The insert 48 comprises a length 78, a width 82, and a volume, wherein the length 78 of the insert can be similar to or less than the length of the shortest cavity (i.e. the cavity length 76A of the first club head 101). Further, in these embodiments, the width 80 of the insert can be similar to or less than the width of the narrowest cavity (i.e. the cavity width 80A of the first club head 101). Further still, in these embodiments, the volume of the insert can be similar to or less than the volume of the smallest cavity (i.e. the cavity 44A of the first club head 101).

Referring to FIG. 9, in many embodiments, the cavity of each club head (i.e. 101, 102, 103) within the set of club heads 100 includes a back wall 84 having a protrusion 86 capable of receiving a recess 88 on a back side 90 of the insert 48 to position or secure the insert 48 within the cavity of any club head 101, 102, 103 within the set of club heads 100. The protrusion 86 on the back wall 84 of the cavity 44A, 44B, 44C and the recess 88 on the back side 90 of the insert 48 can have corresponding geometries, such that the insert 48 can be press-fit over the protrusion 86 in the cavity 44A, 44B, 44C. In these embodiments, the size of the protrusion 90 in the cavity 44A, 44B, 44C does not change with cavity size. Accordingly, a single insert 48 can be positioned over or secured within various cavities having different sizes, as described above.

While the embodiments of FIGS. 9-12 illustrate cavities having protrusions on the back wall that correspond to a recess on the back side of the insert, other embodiments can include cavities having back walls with recesses that correspond to a protrusion on the back side of the insert. Further, in the embodiment illustrated in FIGS. 9-10, the protrusion 86 on the back wall 84 of the cavity 44 and the recess 88 on the back side 90 of the insert 48 comprise cylindrical geometries. In other embodiments, the protrusion 86 and recess 88 can comprise any corresponding geometries, such as an ellipse (FIG. 11), triangle, square, X-shape (FIG. 12), T-shape, L-shape, or any other polygon or shape with at least one curved surface.

Referring to FIG. 6, the lie angles 72 of the club heads 4 within the set of golf clubs 100 vary as the loft angles 68 of the club heads 4 within the set of golf clubs 100 vary. Specifically, the lie angle 72 increases as the loft angle 68 increases for the golf club heads 4 in each set of golf clubs 100. Therefore, the lie angle 72 of the 9-iron is greater than the lie angle 72 of the 8-iron, the lie angle 72 of the 8-iron is greater than the lie angle 72 of the 7-iron, the lie angle 72 of the 7-iron is greater than the lie angle 72 of the 6-iron, the lie angle 72 of the 6-iron is greater than the lie angle 72 of the 5-iron, and the lie angle 72 of the 5-iron is greater than the lie angle 72 of the 4-iron.

For example, with reference to FIG. 6, the lie angle 72 of the 4-iron club head 4 may range from 57-61 degrees, the lie angle 72 of the 5-iron club head 4 may range from 56-63 degrees, the lie angle 72 of the 6-iron club head 4 may range from 57-64 degrees, the lie angle 72 of the 7-iron club head 4 may range from 58-65 degrees, the lie angle 72 of the 8-iron club head 4 may range from 59-64 degrees, and the lie angle 72 of the 9-iron club head 4 may range from 60-67 degrees. In the illustrated embodiment, the lie angle 72 of the 4-iron club head 4 is approximately 59.0 degrees, the lie angle 72 of the 5-iron club head 4 is approximately 60.0 degrees, the lie angle 72 of the 6-iron club head 4 is approximately 60.9 degrees, the lie angle 72 of the 7-iron club head 4 is approximately 61.9 degrees, the lie angle 72 of the 8-iron club head 4 is approximately 62.8 degrees, and the lie angle 72 for the 9-iron club head 4 is approximately 63.8 degrees.

The lie angle 72 of each golf club head 4 within the set of golf clubs 100 may be altered from the lie angle 72 that comes standard for each of the golf club heads 4 within the set of golf clubs 100 to achieve a custom lie angle 104. Hereafter, the lie angle 72 that comes standard for each of the club heads 4 within the set of golf clubs 100 is referred to as the standard lie angle 72. For example, if a particular golfer does not receive a custom fitting, the particular golfer may purchase the set of golf clubs 100 having the standard lie angles 72. If the particular golfer receives a custom fitting, the particular golfer may purchase the set of golf clubs 100 having the custom lie angles 104, wherein the custom lie angles 104 are determined during custom fitting for each individual golfer.

Referring to FIG. 7, the custom lie angle 104 of each of the golf clubs within the set of golf clubs 100, determined during custom fitting is defined herein relative to the standard lie angle 72. For example, the custom lie angle 104 may be upright relative to the standard lie angle 72 of the golf clubs within the set of golf clubs 100. In other words, when the custom lie angle 104 is upright relative to the standard lie angle 72, the custom lie angle 104 is greater than the standard lie angle 72. Further, the custom lie angle 104 may be flat compared to the standard lie angle 72 for the golf clubs within the set of golf clubs 100. In other words, when the custom lie angle 104 is flat relative to the standard lie angle 72, the custom lie angle 104 is less than the standard lie angle 72. The custom lie angles 104 may be the same for each golf club head 4 within the set of golf clubs 100, or the custom lie angles 104 may be different for each golf club head 4 within the set of golf clubs 100. Further, the standard lie angles 72 may be determined to be the best fit for a particular golfer based on custom fitting.

Further referring to FIG. 7, the custom lie angles 104 of the club heads 4 within the set of golf clubs 100 may range from 0-2 degrees upright, 0-5 degrees upright, 0-10 degrees upright or any other range of upright custom lie angles 104. The custom lie angles 104 may also range from 0-2 degrees flat, 0-5 degrees flat, 0-10 degrees flat, or any other range of flat custom lie angles 104. The increments in custom lie angles 104 may be 0.25 degrees, 0.5 degrees, 0.75 degrees, 1 degree, 1.25 degrees, 1.5 degrees, 1.75 degrees, 2 degrees, 2.25 degrees, 2.5 degrees, 2.75 degrees, 3 degrees, or any other degree increment for both upright and flat custom lie angles 104. Further, the increments in custom lie angle 104 may be the same or may differ for both upright and flat custom lie angles 104. In the illustrated embodiment, the custom lie angles 104 include: 0.75 degrees upright, 1.5 degrees upright, 2.25 degrees upright, 3 degrees upright, 3.75 degrees upright, 4.5 degrees upright, 0.75 degrees flat, 1.5 degrees flat, 2.25 degrees flat, 3 degrees flat, and 3.75 degrees flat.

Referring to FIG. 5, the inserts 48 indicate the lie angle 72 of each golf club head 4 within the set of golf clubs 100 by use of an indicator 108. In the illustrated embodiment, the lie angle 72 of each club head 4 is indicated using a color indicator 108. For example, the color indicator 108 for the standard lie angle 72 is black and the color indicators 108 for custom lie angles 104 are as follows: blue indicates the upright lie angle 72 of 0.75 degrees, yellow indicates the upright lie angle 72 of 1.5 degrees, green indicates the upright lie angle 72 of 2.25 degrees, white indicates the upright lie angle 72 of 3 degrees, silver indicates the upright lie angle 72 of 3.75 degrees, maroon indicates the upright lie angle 72 of 4.5 degrees, red indicates the flat lie angle 72 of 0.75 degrees, purple indicates the flat lie angle 72 of 1.5 degrees, orange indicates the flat lie angle 72 of 2.25 degrees, brown indicates the flat lie angle 72 of 3 degrees, and gold indicates the flat lie angle 72 of 3.75 degrees.

In some embodiments, different color coding systems may be used to indicate the lie angles 72 of golf club heads 4 within a set of golf clubs 100. For example, colors other than the colors listed above may be used to indicate the lie angles 72, or the colors listed above may be used in different sequences to indicate the lie angles 72. Further, the inserts 48 may indicate the lie angles 72 using indicators 108 other than colors. For example, the lie angles 72 may be explicitly depicted on the insert 48, letter designations may be used to indicate the lie angles 72, number designations may be used to indicate the lie angles 72, or any other methods may be used to indicate the lie angles 72 on the inserts 48.

As illustrated in FIG. 5, the inserts 48 in the described embodiment function to fill and/or substantially cover the cavities and indicate the lie angles 72 of the golf club heads 4 within the set of golf clubs 100. The inserts 48 may also be weighted to enhance performance characteristics of the golf clubs. For example, each of the inserts 48 may be configured to receive a weight member (not shown). The weight member may be made of tungsten, stainless steel, titanium, other metals, composites, metal alloys, polyurethane, polyurethane reinforced with other materials, or any other material. The weight member may be permanently coupled to the insert 48 or the weight member may be removably coupled to the weight member using a screw, a press fit mechanism, or any other mechanism. Further, each of the inserts 48 may be made of materials having different compositions, different weights, different volumes, different densities, or any combination of the described material variations.

The inserts 48 may also include an electronic positioning system (not shown) to provide further information to the golfer. For example, the information on the insert 48 of a particular golf club may include; yardage to the front of the green, yardage to the back of the green, yardage to the middle of the green, range that the golfer can hit the ball using the particular golf club, or electronic information useful for the golfer. Yardage to the front, middle, and back of a green would align with a particular hole and course for each round.

Figure 8:
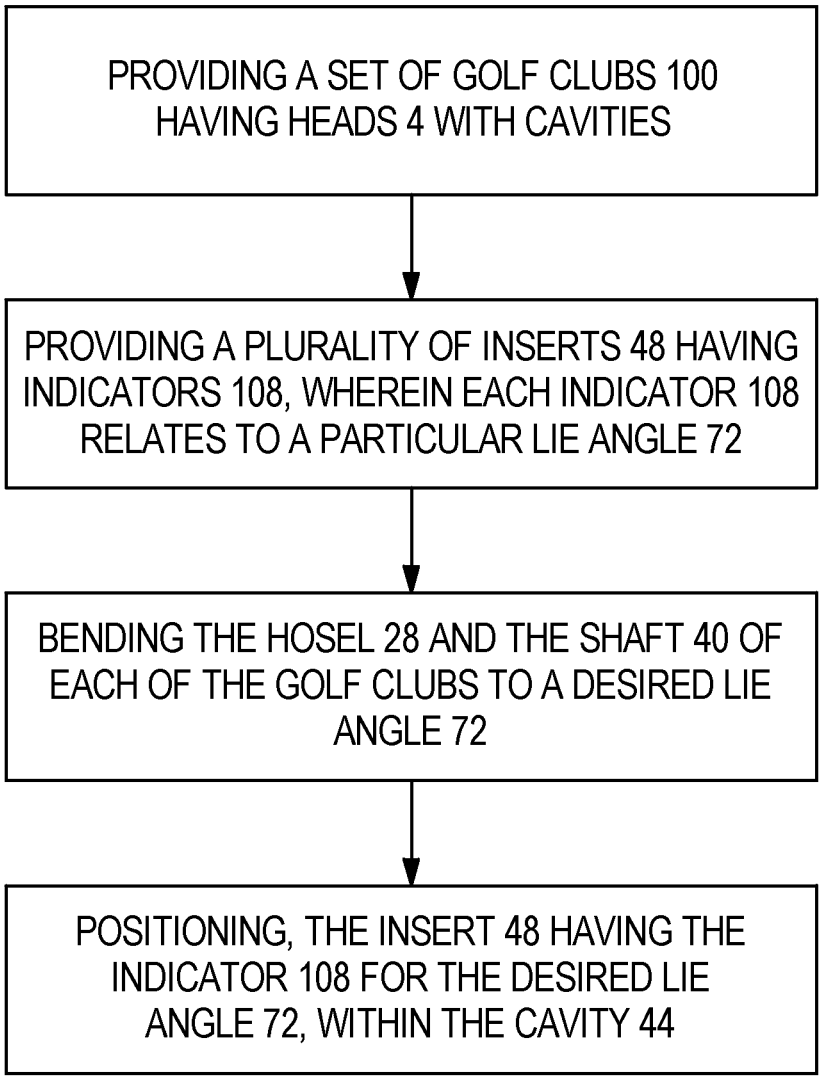
FIG. 8 illustrates a method of manufacturing the set of golf clubs of FIG. 6.

A method of manufacturing the sets of golf clubs having golf club heads 4 with one or more inserts 48 positioned in the cavities of the hosels 28 is illustrated in FIG. 8. The method includes: providing a set of golf clubs 100 having heads 4 with cavities; providing a plurality of inserts 48 having indicators 108, wherein each indicator 108 relates to a particular lie angle 72; bending the hosel 28 and the shaft 40 of each of the golf clubs to a desired lie angle 72; and positioning the insert 48 having the indicator 108 for the desired lie angle 72 within the cavity 44 of the golf club.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A set of golf club heads comprising:

a first golf club head having:

a body having a strike face defining a first loft angle, a heel portion, and a toe portion;

a hosel having a body with a first end, extending from the heel portion of the body of the club head, and a second end, configured to receive a shaft;

a first cavity positioned adjacent to the body of the hosel, the first cavity having a first cavity length, a first cavity width, a first cavity back wall, a first cavity protrusion on the first cavity back wall, two or more protrusions on a first cavity perimeter wall, and a first cavity volume;

a second golf club head having:

a body having a strike face defining a second loft angle greater than the first loft angle, a heel portion, and a toe portion;

a hosel having a body with a first end, extending from the heel portion of the body of the club head, and a second end, configured to receive a shaft;

a second cavity positioned adjacent to the body of the hosel, the second cavity having a second cavity length, a second cavity width, a second cavity back wall, a second cavity protrusion on the second cavity back wall, two or more protrusions on a second cavity perimeter wall, and a second cavity volume, wherein the second cavity length is greater than the first cavity length, the second cavity width is greater than the first cavity width, the second cavity volume is greater than the first cavity volume, or any combination thereof;

an insert capable of being secured within the first or the second cavity;

wherein the insert comprises a recess on a back side;

wherein the insert further comprises two or more grooves on a perimeter of the insert;

wherein either the first or second cavity back wall protrusion is configured to fit within the recess; and wherein the two or more grooves on the perimeter of the insert are configured to receive the two or more protrusions on the first or second cavity perimeter, such that when the insert is secured within the first or second cavity, the insert is press fit into the first or second cavity.

2. The set golf club heads of claim 1, wherein the cavity is located adjacent to the first end of the hosel.

3. The set of golf club heads of claim 1, wherein the first cavity volume and the second cavity volume range from 0.1 $cm^3$ to 0.8 $cm^3$.

4. The set of golf club heads of claim 1, wherein the first cavity length and the second cavity length range from 0.45 inches to 0.75 inches.

5. The set of golf club heads of claim 1, wherein the first cavity width and the second cavity width range from 0.30 inches to 0.35 inches.

6. The set of golf club heads of claim 1, wherein the insert has indicia to indicate the lie angle of the club head.

7. The set of golf club heads of claim 1, wherein the insert is coupled to the hosel over the cavity using a snap fit mechanism;

wherein the snap fit mechanism comprises 1) the first or second cavity back wall protrusion, 2) two or more perimeter wall protrusions of the first or second cavity, 3) two or more grooves on the perimeter of the insert, and 4) the rear wall recess of the insert.

8. The set of golf club heads of claim 1, wherein the insert is coupled to the hosel over the cavity using an adhesive.

9. The set of golf club heads of claim 1, further comprising a third golf club head having:

a body having a strike face defining a third loft angle greater than the second loft angle, a heel portion, and a toe portion;

a hosel having a body with a first end, extending from the heel portion of the body of the club head, and a second end, configured to receive a shaft;

a third cavity positioned adjacent to the body of the hosel, the third cavity having a third cavity length, a third cavity width, and a third cavity volume, wherein the third cavity length is greater than the second cavity length, the third cavity width is greater than the third cavity width, the third cavity volume is greater than the second cavity volume, or any combination thereof;

wherein the insert is capable of being secured within the third cavity.

10. A set of golf clubs comprising:

a first golf club having a first club head comprising:

a body having a strike face defining a first loft angle, a heel portion, and a toe portion;

a hosel having a body with a first end, extending from the heel portion of the body of the club head, and a second end, configured to receive a shaft;

a first cavity positioned adjacent to the body of the hosel, the first cavity having a first cavity length, a first cavity width, a first cavity back wall, a first cavity protrusion on the first cavity back wall, two or more protrusions on a first cavity perimeter wall, and a first cavity volume;

a second golf club having a second club head comprising:

a body having a strike face defining a second loft angle greater than the first loft angle, a heel portion, and a toe portion;

a hosel having a body with a first end, extending from the heel portion of the body of the club head, and a second end, configured to receive a shaft;

a second cavity positioned adjacent to the body of the hosel, the second cavity having a second cavity length, a second cavity width, a second cavity back wall, a second cavity protrusion on the second cavity back wall, two or more protrusions on a second cavity perimeter wall, and a second cavity volume, wherein the second cavity length is greater than the first cavity length, the second cavity width is greater than the first cavity width, the second cavity volume is greater than the first cavity volume, or any combination thereof;

an insert capable of being secured within the first or the second cavity;

wherein the insert comprises a recess on a back side;

wherein the insert further comprises two or more grooves on a perimeter of the insert;

wherein either the first or second cavity back wall protrusion is configured to fit within the recess; and wherein the two or more grooves on the perimeter of the insert are configured to receive the two or more protrusions on the first or second cavity perimeter, such that when the insert is secured within the first or second cavity, the insert is press fit into the first or second cavity.

11. The set golf clubs of claim 10, wherein the cavity is located adjacent to the first end of the hosel.

12. The set of golf clubs of claim 10, wherein the first cavity volume and the second cavity volume range from 0.1 $cm^3$ to 0.8 $cm^3$.

13. The set of golf clubs of claim 10, wherein the first cavity length and the second cavity length range from 0.45 inches to 0.75 inches.

14. The set of golf clubs of claim 10, wherein the first cavity width and the second cavity width range from 0.30 inches to 0.35 inches.

15. The set of golf clubs of claim 10, wherein the insert has indicia to indicate the lie angle of the club head.

16. The set of golf clubs of claim 10, wherein the insert is coupled to the hosel over the cavity using a snap fit mechanism;

wherein the snap fit mechanism comprises 1) the first or second cavity back wall protrusion, 2) two or more perimeter wall protrusions of the first or second cavity, 3) two or more grooves on the perimeter of the insert, and 4) the rear wall recess of the insert.

17. The set of golf clubs of claim 10, wherein the insert is coupled to the hosel over the cavity using an adhesive.

18. The set of golf clubs of claim 10, further comprising a third golf club head having:

a body having a strike face defining a third loft angle greater than the second loft angle, a heel portion, and a toe portion;

a hosel having a body with a first end, extending from the heel portion of the body of the club head, and a second end, configured to receive a shaft;

a third cavity positioned adjacent to the body of the hosel, the third cavity having a third cavity length, a third cavity width, and a third cavity volume, wherein the third cavity length is greater than the second cavity length, the third cavity width is greater than the third cavity width, the third cavity volume is greater than the second cavity volume, or any combination thereof;

wherein the insert is capable of being secured within the third cavity.

* * * * *